US005930558A

United States Patent [19]

Raus, Sr. et al.

[11] Patent Number: 5,930,558

[45] Date of Patent: Jul. 27, 1999

[54] HEATED AIR BLOWER FOR REDUCING HUMIDITY ABSORPTION IN PAPER

[75] Inventors: Robert W. Raus, Sr., Fairport; Stephen N. Costanza, Rochester, both of N.Y.

[73] Assignee: Xerox Corporation, Stamford, Conn.

[21] Appl. No.: 09/105,385

[22] Filed: Jun. 26, 1998

[51] Int. Cl.[6] ..... G03G 15/00; G03G 21/20

[52] U.S. Cl. ..... 399/97; 399/44; 399/92

[58] Field of Search ..... 399/44, 92, 94, 399/97; 219/216, 388, 471; 62/92; 165/222; 236/44; 244/118.5; 454/238; 271/3.03, 3.05, 9.01, 11

[56] References Cited

U.S. PATENT DOCUMENTS 3,848,988 11/1974 Thettu et al. ..... 355/3 R 5,421,097 6/1995 Yamamoto et al. ..... 34/446

5,600,427 2/1997 Watanabe et al. ..... 399/97

*Primary Examiner*—Arthur T. Grimley

*Assistant Examiner*—Hoang Ngo

*Attorney, Agent, or Firm*—Ronald F. Chapuran

[57] ABSTRACT

A sheet repository having multiple trays and including a fan supported in a housing for receiving ambient air from outside the housing, a heating device within the housing for raising the temperature of the air conveyed by the fan, and a duct system at the outlet of the heating device for channeling the heated air. The duct system includes outlets for directing heated air onto the selected trays, and a humidity sensor provides suitable signals to shut off the heating device in order that the sheets in the trays are maintained at a uniform reduced moisture content.

5 Claims, 2 Drawing Sheets

HEATED AIR BLOWER FOR REDUCING HUMIDITY ABSORPTION IN PAPER

BACKGROUND OF THE INVENTION

The invention relates to an air blower system and more particularly, to a system for blowing heated air into ducts and trays for reducing moisture in paper.

In many copier environments and, in particular, in electrostatic copiers, controlling the moisture content contained in the final support material, upon which copies are produced, is extremely important in order to insure that constant high quality copy is produced. When the moisture level in the material is allowed to become excessively high, the copy material itself acts in a deleterious manner to effect the various processing systems. For example, excessive moisture carried by the support material can rob energy from a heat fuser and thus seriously reduce the quality of image fixing that is produced. Similarly, as in the reusable xerographic process where a toner image is electrically transferred from a photoconductive plate to the final support sheet, excessive moisture in the support material will degrade the electrical characteristics of the transfer system and result in relatively incomplete or non-uniform transferring of images to the final support material.

It is known in the prior art as disclosed in U.S. Pat. No. 3,848,988, assigned to the same assignee as the present invention, to convey excess heat from a fuser system to the trays holding copy sheets. In particular, a pair of evaporators are supported in close proximity to a backup fuser roll surface. When the surface temperature of the backup roll exceeds a predetermine operating level, vapors are collected in chambers provided with each of the evaporators. The vapor chambers are connected to condensers associated with each of the copy sheet supply stations by means of a vapor line. Each of the condensers includes a condensing coil to facilitate the discharge of energy into the copy sheet supply stations. Each condenser also contains an electric resistance heater to provide energy when the machine is in a standby condition or during periods in which a low volume of copy is produced.

The system as described in U.S. Pat. No. 3,848,988 is a complex system of evaporators, condensers, interconnecting vapor lines and return lines, and auxiliary heating elements depending upon machine status. It would be desirable to provide a relatively simple and direct method of removing moisture from copy sheets in copy sheet trays. It is an object of the present invention, therefore, to provide a simple and direct system to raise the temperature of ambient air and directly convey the heated air to the copy sheets and copy sheet trays to remove humidity. It is another object of the present invention to provide a simple humidity sensor to control the operation of a heating fan providing moisture reducing air to the copy sheet trays.

Further advantages of the present invention will become apparent as the following description proceeds and the features characterizing the invention will be pointed out with particularity in the claims annexed to and forming a part of this specification.

SUMMARY OF THE INVENTION

Briefly, the present invention is a sheet repository having multiple trays and including a fan supported in a housing for receiving ambient air from outside the housing, a heating device within the housing for raising the temperature of the air conveyed by the fan, and a duct system at the outlet of the heating device for channeling the heated air. The duct system includes outlets for directing heated air onto the selected trays, and a humidity sensor provides suitable signals to shut off the heating device in order that the sheets in the trays are maintained at a uniform reduced moisture content.

DESCRIPTION OF THE DRAWINGS

For a better understanding of the present invention, reference may be had to the accompanying drawings wherein the same reference numerals have been applied to like parts and wherein.

DETAILED DESCRIPTION OF THE INVENTION

In accordance with the present invention, an air blower system, including an air movement device, heater element, and ducts provides heated air into each of a plurality of paper trays for the purpose of reducing the amount of moisture in the paper. This allows the paper to be flatter, reduces the number in size of printed deletions, and further inhibits paper wrinkle.

In a preferred embodiment, a sheet repository includes multiple trays with each adapted to receive a plurality of copy sheets. A fan is supported in a housing for receiving ambient and a heating device is disposed within the housing for raising the temperature of the air conveyed by the fan. An air duct channels the heated air to the copy sheet trays through selected outlets to remove an appropriate amount of moisture from the copy sheets in the trays. A humidity sensor situated within the repository provides suitable signals to shut off the heating device to maintain the sheets in the trays at a uniform reduced moisture content.

Figure 1:
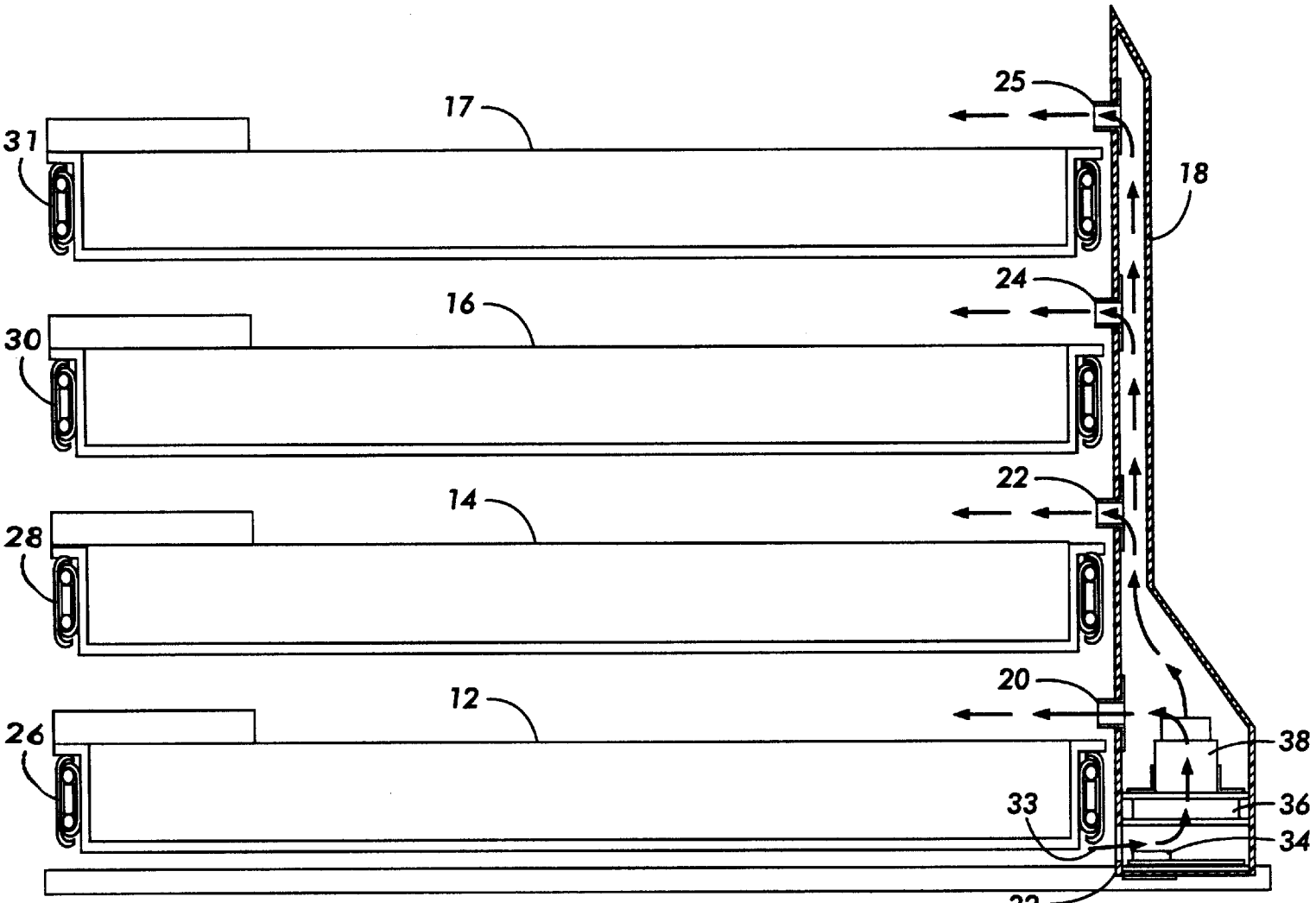
FIG. 1 is a side view of a heated air blower system in accordance with the present invention.
Figure 2:
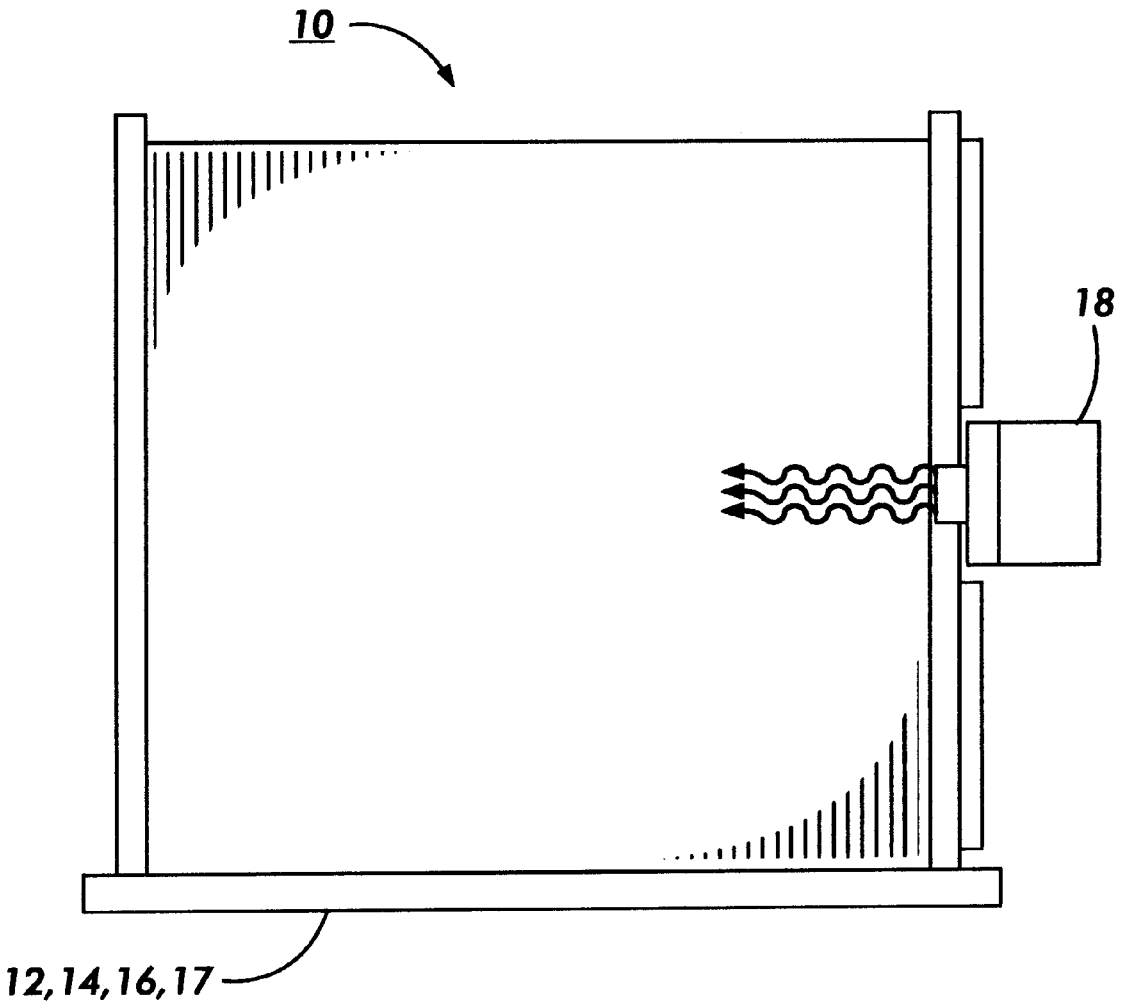
FIG. 2 is at view of the heated air blower system in accordance with the present invention.

Specifically with reference to FIGS. 1 and 2, there is shown a paper or copy sheet repository generally illustrated at 10 providing a multiple number of sheet trays 12, 14, 16, and 17 interconnected to an air or heating duct 18. Outlets to the paper trays 12, 14, 16, and 17 from the air duct 18 are shown at 20, 22, 24, and 25. Tray guides and stops are shown at 26, 28, 30, and 31.

In operation, ambient air is drawn into a housing 32 as illustrated by arrow 33. A humidity sensor 34 provides a measure of the air humidity contact to a suitable, not shown control. A fan 36 blows the air through a heating element such as a coil illustrated at 38 through the duct 18 and the outlets 20, 22, 24, and 25 to suitably extract moisture from the sheets in the trays 12, 14, 16, and 17.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. In a sheet repository having multiple trays, each tray adapted to receive paper sheets having a system for reducing humidity in the paper sheets in the trays comprising:

a fan supported in a housing for receiving ambient air from outside the housing through an air intake section;

a heating device disposed within the housing for raising the temperature of the air conveyed by the fan, a duct disposed at the outlet of the heating device for channeling the heated air, the duct including outlets communicating with selected trays, the heated air being directed onto the selected trays, and a humidity sensor disposed within the repository, the humidity sensor being positioned within the air intake section, the sensor providing suitable signals to shut off the heating device whereby the sheets in the trays are maintained at a uniform reduced moisture content.

2. The sheet repository of claim 1 wherein the air intake section, the fan, and the heating device are disposed in an essentially vertical placement within the housing.

3. In a sheet repository having multiple trays, each tray adapted to receive paper sheets a system for reducing humidity in the paper sheets in the trays comprising:

a fan supported in a housing for receiving ambient air from outside the housing through an air intake section, a heating device disposed within the housing for raising the temperature of the air conveyed by the fan, and a duct disposed at the outlet of the heating device for channeling the heated air, the duct including outlets communicating with selected trays, the heated air being directed onto the selected trays, the air intake section, the fan, and the heating device being disposed in an essentially vertical placement within the sheet repository.

4. The sheet repository of claim 3 including a humidity sensor disposed within the repository, the sensor providing suitable signals to shut off the heating device whereby the sheets in the trays are maintained at a uniform reduced moisture content.

5. The sheet repository of claim 4 including an air intake section communicating with the fan, the humidity sensor being positioned within the air intake section.

* * * * *